US006417436B1

(12) United States Patent
Beyoung-Wook

(10) Patent No.: US 6,417,436 B1
(45) Date of Patent: Jul. 9, 2002

(54) HAND-OPERATED DANCING MACHINE

(75) Inventor: Kim Beyoung-Wook, Seoul (KR)

(73) Assignee: Interzone 21 Co., Ltd., Seoul (KR)

( * ) Notice: Subject to any disclaimer, the term of this patent is extended or adjusted under 35 U.S.C. 154(b) by 0 days.

(21) Appl. No.: 09/693,266

(22) Filed: Oct. 20, 2000

(30) Foreign Application Priority Data

Aug. 22, 2000 (KR) ..... 2000-48678

(51) Int. Cl.[7] ..... A63J 17/00; G10H 1/34

(52) U.S. Cl. ..... 84/600; 84/644; 84/464 R; 84/DIG. 6

(58) Field of Search ..... 84/600–602, 644, 84/670, 721, 746, 470 R, 477 R, 478, 464 R, 464 A, DIG. 6; 434/307 A

(56) References Cited

U.S. PATENT DOCUMENTS 5,739,457 A * 4/1998 Devecka ..... 84/600 X

* cited by examiner

*Primary Examiner*—Stanley J. Witkowski
(74) *Attorney, Agent, or Firm*—Sierra Patent Group, Ltd.

(57) ABSTRACT

A hand-operated dancing machine wherein hand-operated percussion instruments are configured in an electronic manner to be operated for entertainment and generate a variety of sounds such as a tambourine sound, bongo sound, conga sound, etc., so that the user can frequently use the upper half of his body while he plays various games. The dancing machine comprises a plurality of tub input units for inputting corresponding hit signals from the user's hands, an auxiliary input unit for inputting a hit signal from the user's feet, a coin manager for managing the input of coins, a graphic controller for controlling the configuration of an image on a screen of a monitor, a sound controller for controlling the arrangement of percussion instruments' sounds and music through a speaker, an illumination controller for controlling the intensity of illumination of decoration lamps, and a central processing unit for centrally controlling the graphic controller, sound controller and illumination controller in response to output signals from the tub input units or an output signal from the auxiliary input unit for the control of the image configuration, the percussion instruments' sounds and music arrangement and the illumination intensity.

3 Claims, 6 Drawing Sheets

HAND-OPERATED DANCING MACHINE

BACKGROUND OF THE INVENTION

1. Field of the Invention

The present invention relates in general to dancing machines, and more particularly to a hand-operated dancing machine wherein hand-operated percussion instruments such as a tambourine, bongo, conga, etc. are configured in an electronic manner to be operated for entertainment.

2. Description of the Prior Art

As well known, conventional dancing machines are mostly operated by the user's feet, such as with dance dance revolution (DDR).

However, because the user operates such a conventional dancing machine using only his feet, he hardly uses his body, more particularly its upper half. Further, the user cannot help playing a very monotonous game, in that he only dances to a specific music rhythm.

SUMMARY OF THE INVENTION

Therefore, the present invention has been made in view of the above problems, and it is an object of the present invention to provide a hand-operated dancing machine wherein hand-operated percussion instruments are configured in an electronic manner to be operated for entertainment and generate a variety of sounds such as a tambourine sound, bongo sound, conga sound, etc., so that the user can frequently use the upper half of his body while he plays various games.

In accordance with the present invention, the above and other objects can be accomplished by a provision of a hand-operated dancing machine comprising a plurality of tub input units for inputting corresponding hit signals from the user's hands; an auxiliary input unit for inputting a hit signal from the user's feet; a coin manager for managing the input of coins; a graphic controller for controlling the configuration of an image on a screen of a monitor; a sound controller for controlling the arrangement of percussion instruments' sounds and music through a speaker; an illumination controller for controlling the intensity of illumination of decoration lamps; a central processing unit for centrally controlling the graphic controller, sound controller and illumination controller in response to output signals from the tub input units or an output signal from the auxiliary input unit for the control of the image configuration, the percussion instruments' sounds and music arrangement and the illumination intensity; an auxiliary memory for storing a variety of music data and percussion instrument sound data under the control of the central processing unit; a random access memory loaded with the music data and percussion instrument sound data stored in the auxiliary memory under the control of the central processing unit; and a read only memory for storing a system operating program.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1:
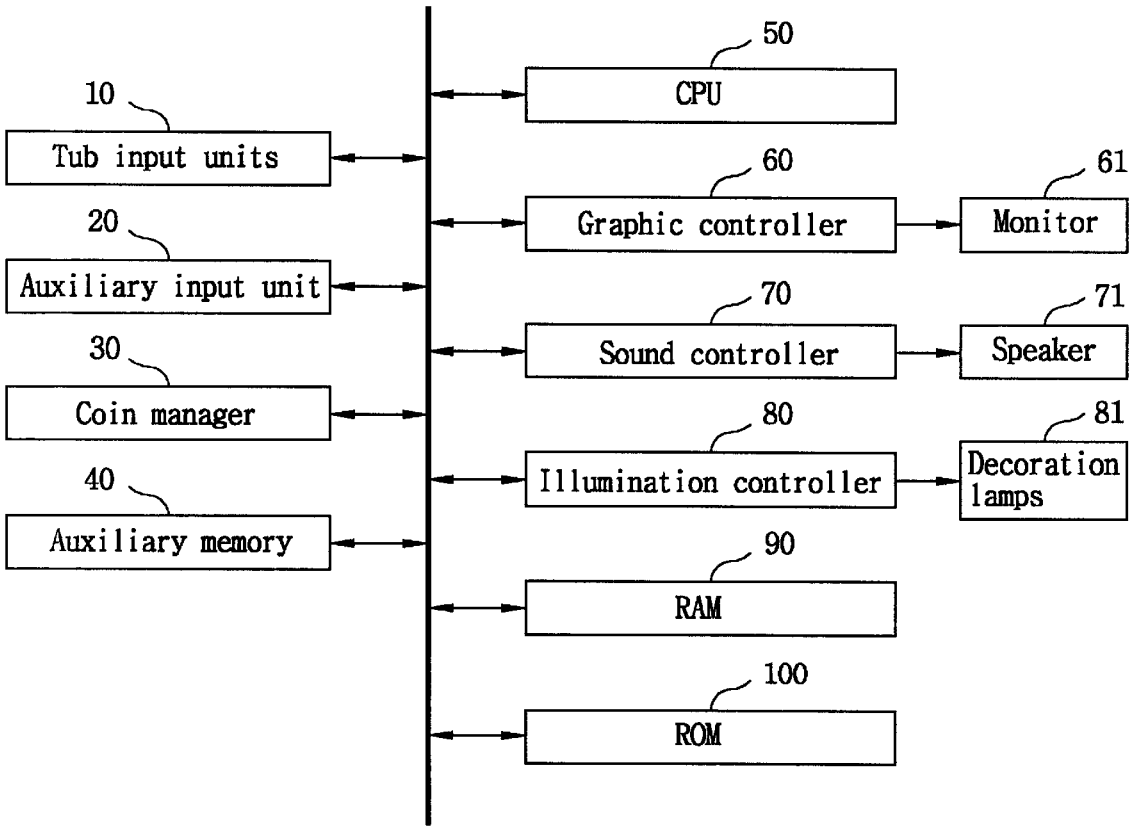
FIG. 1 is a block diagram showing an internal circuitry construction of a hand-operated dancing machine in accordance with the present invention.
Figure 2:
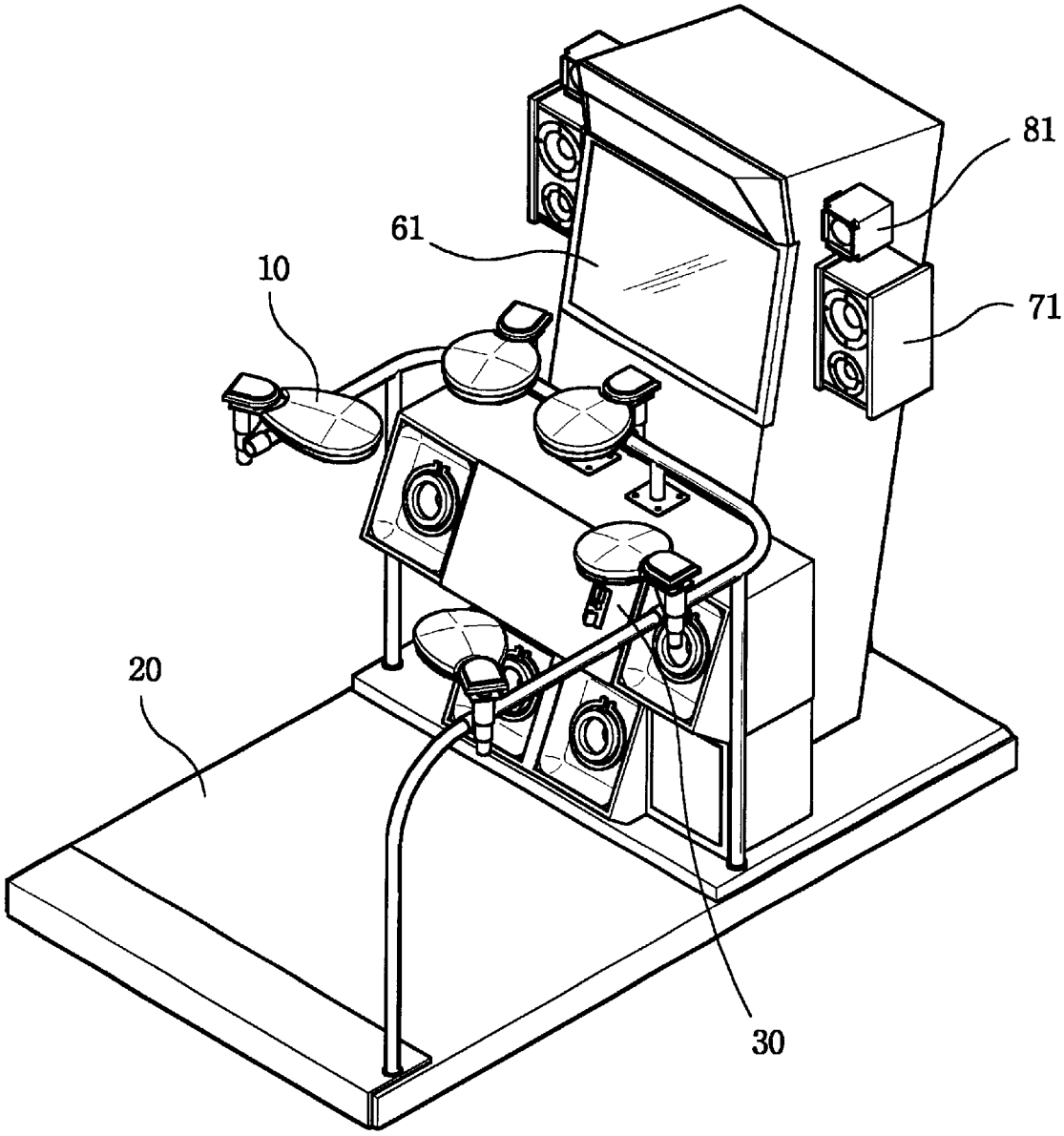
FIG. 2 is a perspective view showing the outer appearance of the hand-operated dancing machine in accordance with the present invention.

FIG. 1 is a block diagram showing an internal circuitry construction of a hand-operated dancing machine in accordance with the present invention and FIG. 2 is a perspective view showing the outer appearance of the hand-operated dancing machine in accordance with the present invention.

As shown in these drawings, the hand-operated dancing machine comprises a plurality of tub input units 10 for inputting corresponding hit signals from the user's hands, an auxiliary input unit 20 for inputting a hit signal from the user's feet, a coin manager 30 for managing the input of coins, a graphic controller 60 for controlling the configuration of an image on a screen of a monitor 61, a sound controller 70 for controlling the arrangement of percussion instruments' sounds and music through a speaker 71, and an illumination controller 80 for controlling the intensity of illumination of decoration lamps 81. The hand-operated dancing machine further comprises a central processing unit (CPU) 50 for centrally controlling the graphic controller 60, sound controller 70 and illumination controller 80 in response to output signals from the tub input units 10 or an output signal from the auxiliary input unit 20 for the control of the image configuration, the percussion instruments' sounds and music arrangement and the illumination intensity, an auxiliary memory 40 for storing a variety of music data and percussion instrument sound data under the control of the CPU 50, a random access memory (RAM) 90 loaded with the music data and percussion instrument sound data stored in the auxiliary memory 40 under the control of the CPU 50, and a read only memory (ROM) 100 for storing a system operating program.

The tub input units 10 may preferably be five in number to correspond respectively to percussion instruments such as a tambourine, bongo, conga, etc. and be separately positioned around the area of the user's hands. For example, the tub input unit 10 corresponding to the tambourine, which generates a high-frequency sound, may be held in the right side part of a support frame, and the tub input units 10 corresponding respectively to the bongo and conga, which generate low-frequency base sounds, may be held in the front part of the support frame, as shown in FIG. 2. The auxiliary input unit 20 may preferably be a foot pedal which is rotated clockwise at an angle of about 30° to enable the user to shake himself to a given music rhythm.

Now, a detailed description will be given of the operation of the hand-operated dancing machine with the above-stated construction in accordance with the present invention with reference to FIGS. 3 to 6.

Figure 3:
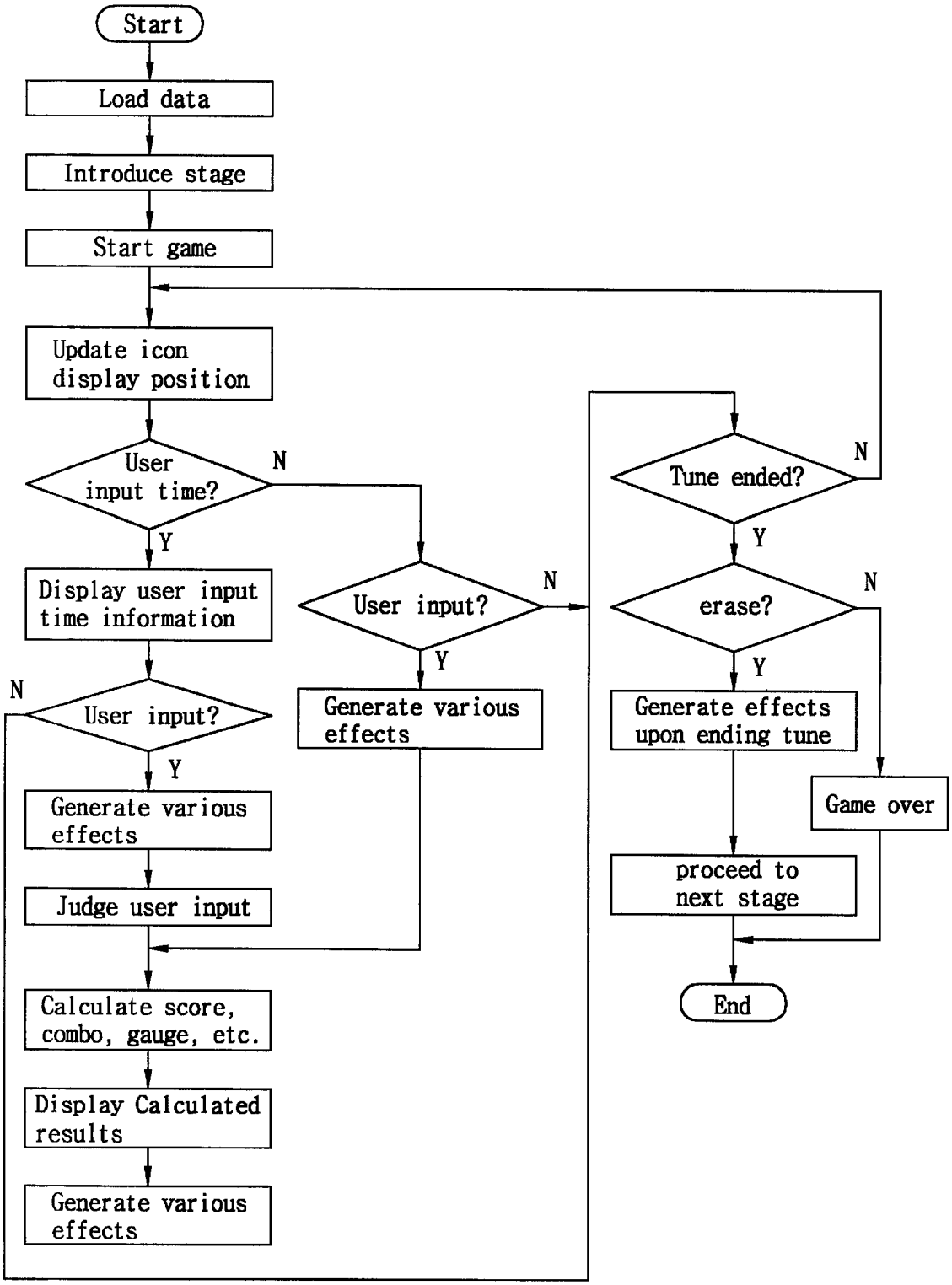
FIGS. 3, 4*a* and 4*b* are flowcharts illustrating the operation of the hand-operated dancing machine in accordance with the present invention.
Figure 4A:
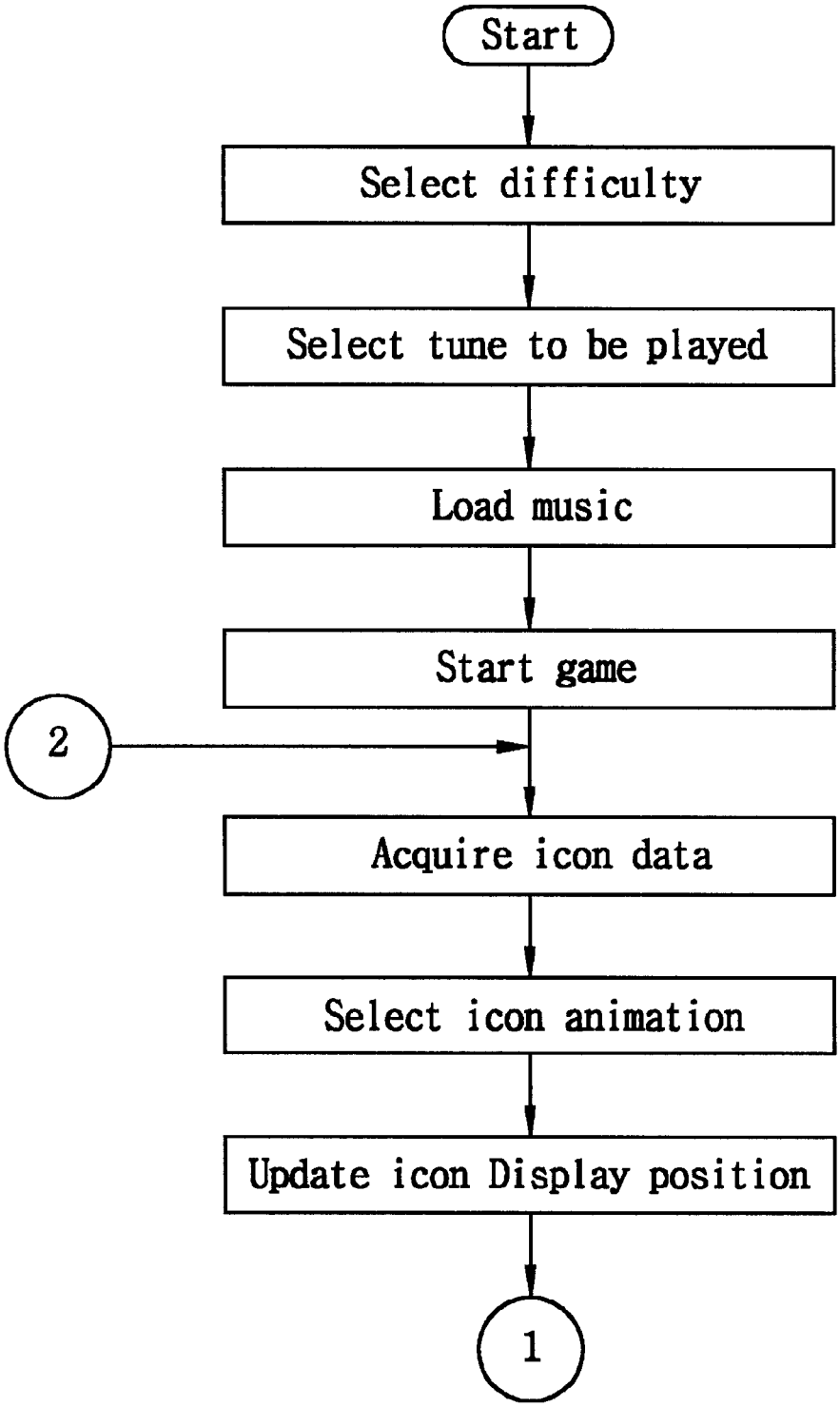
Figure 4B:
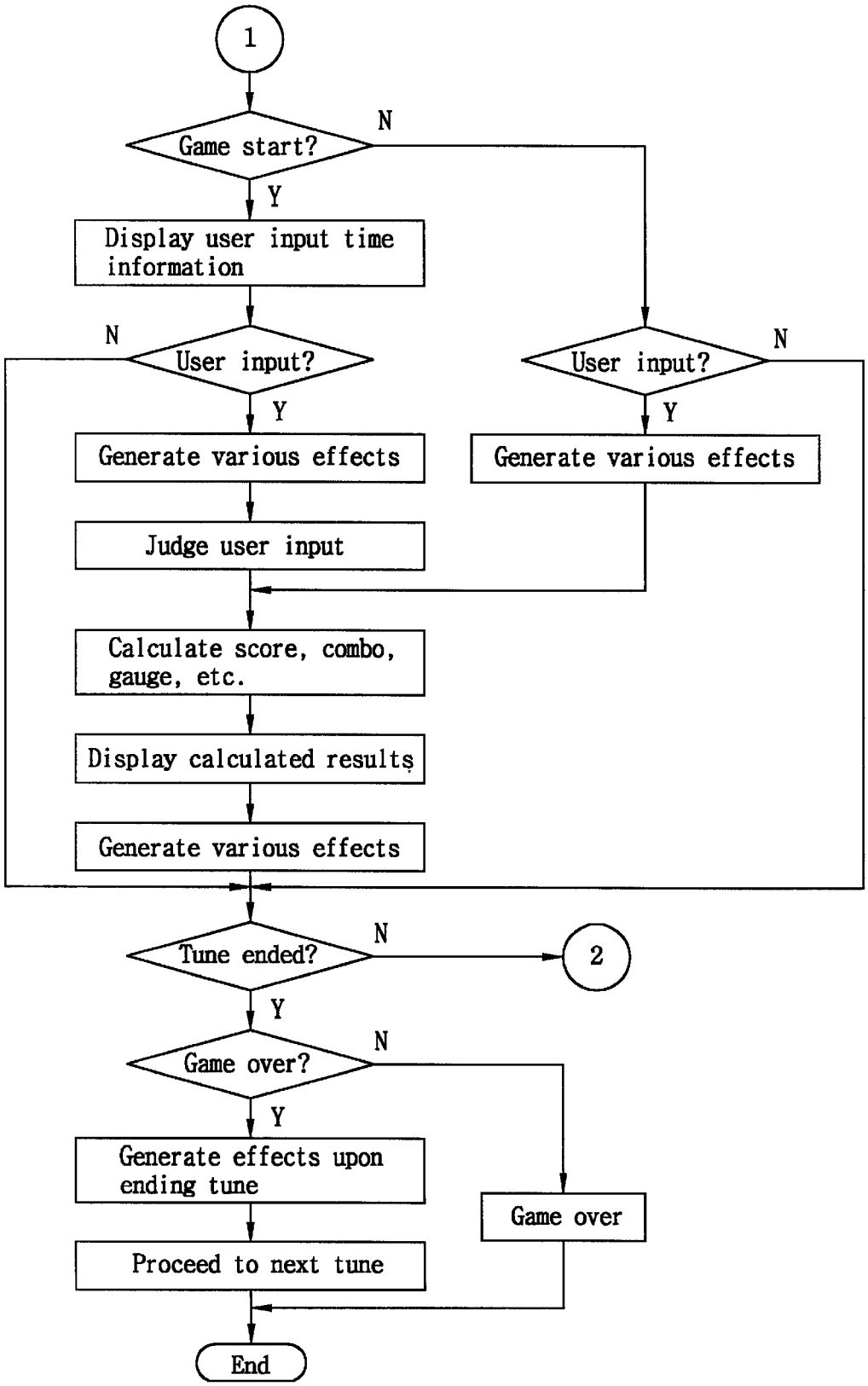
Figure 5:
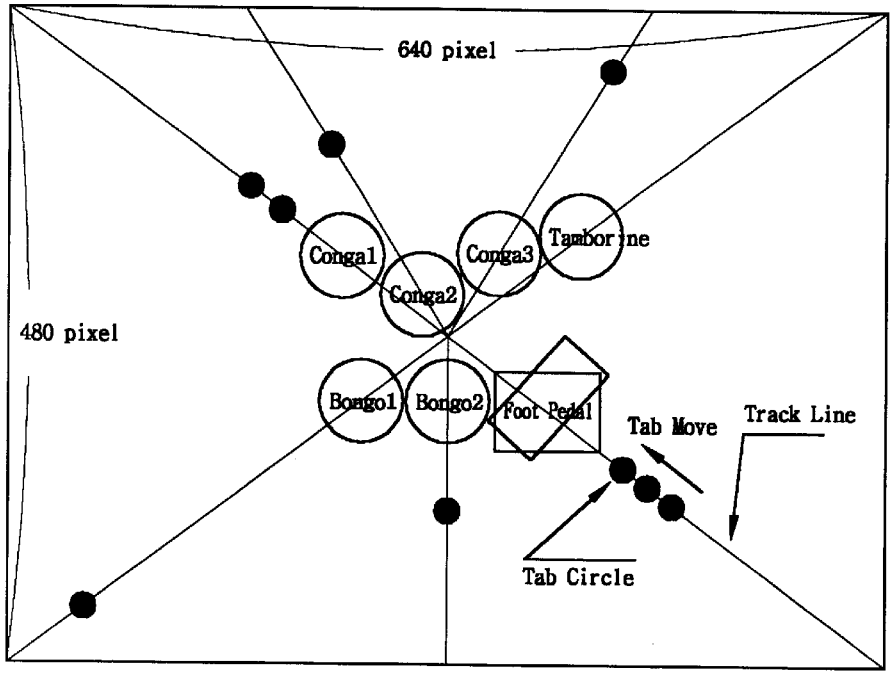
FIGS. 5 and 6 are views illustrating examples of screen images of the hand-operated dancing machine in accordance with the present invention.
Figure 6:
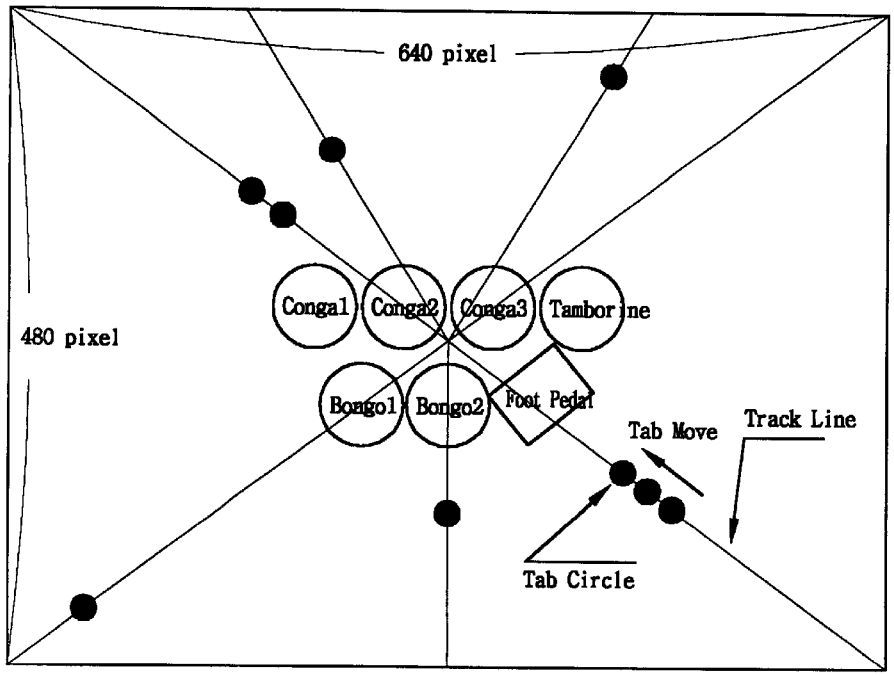

FIGS. 3, 4*a* and 4*b* are flowcharts illustrating the operation of the hand-operated dancing machine in accordance with the present invention and FIGS. 5 and 6 are views illustrating examples of screen images of the hand-operated dancing machine in accordance with the present invention.

As shown in FIG. 3, first, if the user turns on the present dancing machine and selects the degree of game difficulty and a tune to be played, then the CPU 50 loads a variety of data stored in the auxiliary memory 40 into the RAM 90, introduces the current stage and starts a given game according to the system operating program stored in the ROM 100.

When the given game is started, the CPU 50 acquires icon data, updates an icon animation and icon display position and determines whether the current time is a user input time. If the current time is the user input time, then the CPU 50 displays information about the fact that the current time is the user input time and determines whether a user input is made. If the user input is made, then the CPU 50 generates a variety of effects and judges the user input. Thereafter, the CPU 50 calculates a score, combo, gauge, etc. in accordance with the judged result, displays the calculated results on the screen of the monitor 61 and performs the corresponding music.

At this time, the graphic controller 60 controls the configuration of an image on the screen of the monitor 61, the sound controller 70 controls the arrangement of percussion instruments' sounds and music through the speaker 71, and the illumination controller 80 controls the intensity of illumination of the decoration lamps 81.

As seen from FIGS. 5 and 6, the user can obtain a score only when he touches a corresponding one of the tub input units 10 and auxiliary input unit 20 at a user input point (touch point) of time, or at the moment that a given icon moves to the position of the tambourine, bongo, conga or foot pedal displayed on the screen and overlaps it.

On the other hand, in the case where there is a user input when the current time is not the user input time, the CPU 50 generates a variety of effects different from the above. However, in the case where there is no user input when the current time is not the user input time, the CPU 50 determines whether the selected tune has reached its end point. If the selected tune has reached its end point, then the CPU 50 ends the performed music. If this is not so, the CPU 50 continues to play the given game.

After ending the performed music, the CPU 50 determines whether there is an erase command from the user. If the erase command is present, then the CPU 50 generates effects upon ending the selected tune and proceeds to the next stage. However, if the erase command is not present, the CPU 50 ends the given game.

In the system of FIG. 5, the user can recognize as an instrument playing point of time the moment that each tab circle icon moves from a corresponding edge of the screen along a track line and reaches a hardware interface at the center of the screen. In this manner, the user can play the dancing machine while directly observing the screen. Because this system is different in touch points whereas it is an ideal display system where each tab circle one-to-one corresponds to the hardware interface, the user has a considerable difficulty in performing the dancing machine. As a result, the system of FIG. 5 is applied to a hard level mode.

In the system of FIG. 6, touch points are the same whereas each tab circle does not perfectly correspond to the hardware interface. As a result, novices can conveniently perform the dancing machine. Each touch point occurs at the moment that each tab circle moves from a corresponding edge of the screen along a track line and reaches the center of the screen where instrument images are arranged. This system can be highlighted as a very directly observable interface system. Each tub may preferably have a circular shape and such a color as to be easily conspicuous in spite of splendorous effects on the background.

As apparent from the above description, hand-operated percussion instruments are configured in an electronic manner to be operated for entertainment and generate a variety of sounds such as a tambourine sound, bongo sound, conga sound, etc. Therefore, the user can play various games with more enjoyment by frequently using the upper half of his body.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hand-operated dancing machine comprising:

a plurality of tub input units for inputting corresponding hit signals from the user's hands;

an auxiliary input unit for inputting a hit signal from the user's feet;

a coin manager for managing the input of coins;

a graphic controller for controlling the configuration of an image on a screen of a monitor;

a sound controller for controlling the arrangement of percussion instruments' sounds and music through a speaker;

an illumination controller for controlling the intensity of illumination of decoration lamps; and a central processing unit for centrally controlling said graphic controller, sound controller and illumination controller in response to output signals from said tub input units or an output signal from said auxiliary input unit for the control of the image configuration, the percussion instruments' sounds and music arrangement and the illumination intensity.

2. A hand-operated dancing machine as set forth in claim 1, further comprising an auxiliary memory for storing a variety of music data and percussion instrument sound data under the control of said central processing unit.

3. A hand-operated dancing machine as set forth in claim 2, further comprising:

a random access memory loaded with said music data and percussion instrument sound data stored in said auxiliary memory under the control of said central processing unit; and a read only memory for storing a system operating program.

* * * * *